United States Patent [19]

Muecke et al.

[11] 4,139,060

[45] Feb. 13, 1979

[54] SELECTIVE WELLBORE ISOLATION USING BUOYANT BALL SEALERS

[75] Inventors: Thomas W. Muecke; Claude E. Cooke, Jr.; Clay Gruesbeck, Jr., all of Houston, Tex.

[73] Assignee: Exxon Production Research Company, Houston, Tex.

[21] Appl. No.: 850,879

[22] Filed: Nov. 14, 1977

[51] Int. Cl.[2] ..... E21B 33/13; E21B 43/26; E21B 43/27

[52] U.S. Cl. ..... 166/281; 166/284

[58] Field of Search ..... 166/284, 281, 307, 308, 166/192, 269

[56] References Cited

U.S. PATENT DOCUMENTS

| | | | |
|---|---|---|---|
| 2,754,910 | 7/1956 | Derrick et al. | 166/284 |
| 2,933,136 | 4/1960 | Ayers et al. | 166/284 |
| 3,011,548 | 12/1961 | Holt | 166/284 |
| 3,174,546 | 3/1965 | Flickinger | 166/269 |
| 3,292,700 | 12/1966 | Berry | 166/284 |
| 3,376,934 | 4/1968 | Willman et al. | 166/284 X |
| 3,437,147 | 4/1969 | Davies | 166/284 |
| 3,547,197 | 12/1970 | Chevalier et al. | 166/284 |
| 3,595,314 | 7/1971 | Garner | 166/192 |
| 3,715,055 | 2/1973 | Kendrick et al. | 221/75 |
| 3,895,678 | 7/1975 | Wright et al. | 166/284 |

OTHER PUBLICATIONS

Brown et al., "Stimulation Treatment Selectivity Through Perforation Ball Sealer Technology", *The Petroleum Engineer,* 6-1959, 8 pages.

Howard, "Ball Sealers in Fracturing and Acidizing", Canadian Oil and Gas Industries, Jan. 1962, pp. 43-46.

Neill et al., "An Inexpensive Method of Multiple Fracturing", Drilling and Production Practice, American Petroleum Institute, 1958, N. Y., N. Y., pp. 27-32.

Permeator Corp. (Canada) Ltd., "Permeator Well Completion Operator's Manual", Revised 9-1967, copyright 1964, pp. 30-33.

*Primary Examiner*—Stephen J. Novosad

*Attorney, Agent, or Firm*—Gary D. Lawson; James A. Reilly

[57] ABSTRACT

A method is described for using ball sealers as a diverting agent when treating a subterranean formation penetrated by a well provided with casing having perforations at a plurality of levels. Ball sealers sized to plug a perforation, a first fluid having a density greater than the ball sealers and a second fluid less dense than the ball sealers are introduced into the casing concurrently or in any order. The amount of the first fluid introduced should be sufficient to fill the lower portion of the casing to a level between the lower perforations to be plugged and the upper perforations to be left open to fluid flow. Once the ball sealers are disposed below the upper perforations, treating fluid is injected into the casing to cause a flow of the second fluid through the lower perforations to carry the ball sealers down the casing to plug the lower perforations and to cause fluid flow through the upper perforation which the ball sealers did not plug.

16 Claims, 1 Drawing Figure

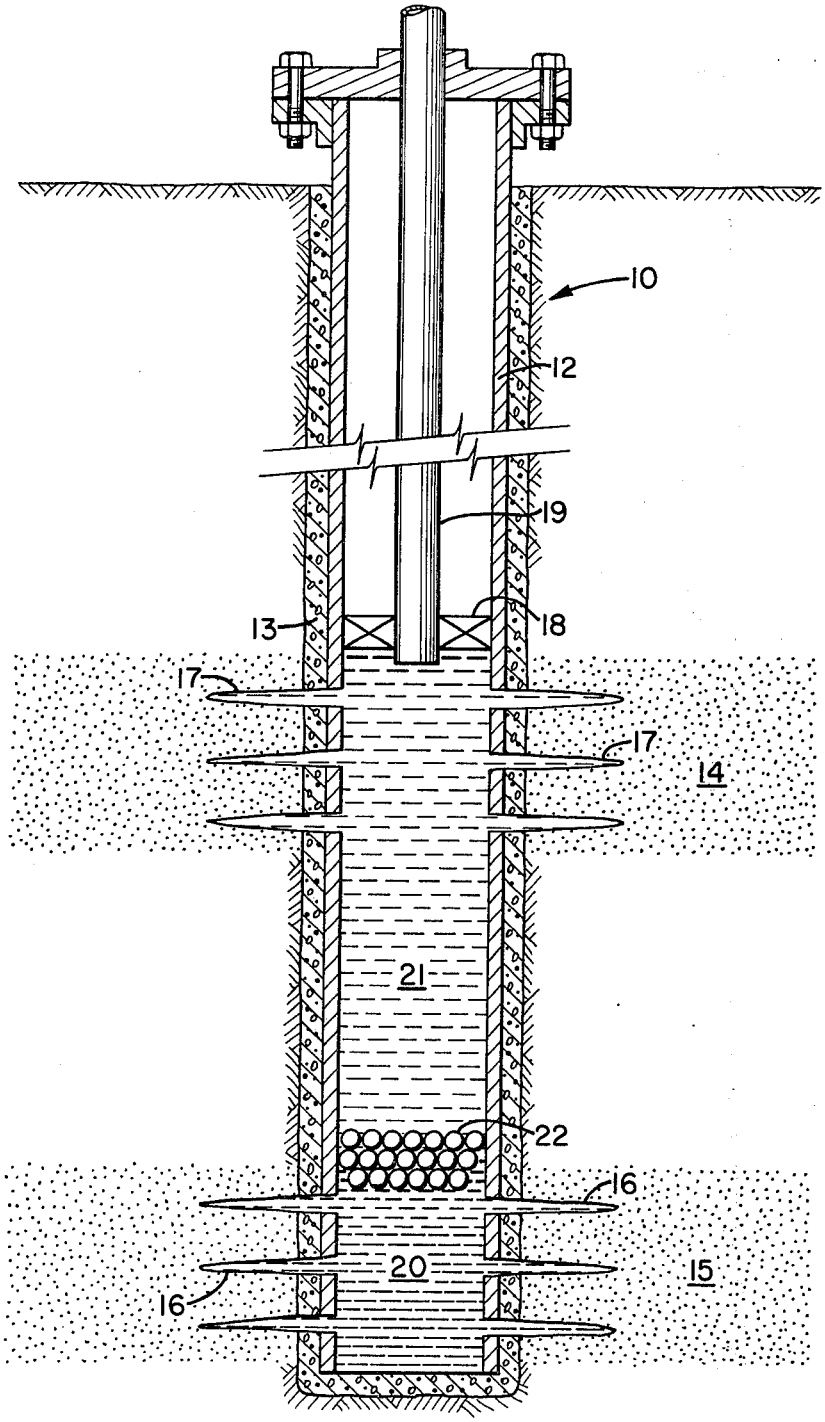
10
12
19
13
18
17
17
14
21
22
16
20
15
16

SELECTIVE WELLBORE ISOLATION USING BUOYANT BALL SEALERS

BACKGROUND OF THE INVENTION

1. Field of the Invention

This invention pertains to the treating of subterranean formations penetrated by a well. More particularly, the method is directed to a method for selectively treating a plurality of formation intervals using ball sealers.

2. Description of the Prior Art

It is common practice in completing oil and gas wells to set a string of pipe, known as casing, in the well and use cement around the outside of the casing to isolate the various hydrocarbon productive formations penetrated by the well. To establish fluid communication between the hydrocarbon bearing formations and the interior of the casing, the casing and cement sheath are perforated.

At various times during the life of the well, it may be desirable to increase the production rate of hydrocarbons by acid treatment or hydraulic fracturing. If only a short, single hydrocarbon-bearing zone in the well has been perforated, the treating fluid will flow into this productive zone. As the length of the perforated zone or the number of perforated zones increases, treatment of the entire productive zone or zones becomes more difficult. For instance, the strata having the highest permeability will most likely consume the major portion of a given stimulation treatment leaving the least permeable strata virtually untreated. To overcome this problem, it has been proposed to divert the treating fluid from the high permeability zones to the low permeability zones.

Various techniques for selectively treating multiple zones have been suggested including techniques using packers, baffles and balls, bridge plugs, and ball sealers.

Packers have been used extensively for separating zones for treatment. Although these devices are effective, they are expensive to use because of the associated workover equipment required during the tubing packer manipulations. Moreover, mechanical reliability tends to decrease as the depth of the well increases.

In using a baffle and ball to separate zones, a baffle ring, which fits between two joints of casing, has a slightly smaller inside diameter than the casing so that a large ball, or bomb, dropped in the casing will seat in the baffle. After the ball is seated in the baffle, the ball prevents fluid flow down the hole. One disadvantage with this method is the extra expense of placing the baffle. Moreover, if two or more baffles are used the inside diameter of the bottom baffle is so small that a standard perforating gun cannot be used to perforate below the bottom baffle.

A bridge plug, which is comprised principally of slips, a plug mandrel, and a rubber sealing element, has also been run and set in casing to isolate a lower zone while treating an upper section. After fracturing or acidizing the well, the plug is generally knocked to the well bottom with a chisel bailer. One difficulty with the bridge plug method is that the plug sometimes does not withstand high differential pressures. Another problem with this diverting technique is that placement and removal of the plug can be expensive.

One of the more popular and widely used diverting techniques uses ball sealers. In a typical method, ball sealers are pumped into the well along with formation treating fluid. The balls are carried down the wellbore and to the perforations by the fluid flow through the perforations. The balls seat upon the perforations and are held there by the pressure differential across the perforations.

Although ball sealer diverting techniques have met with considerable usage, the balls often do not perform effectively because only a fraction of the balls injected actually seat on perforations. Ball sealers having a density greater than the treating fluid will often yield a low and unpredictable seating efficiency highly dependent on the difference in density between the ball sealers and the fluid, the flow rate of the fluid through the perforations, and the number, spacing and orientation of the perforations. The net result is that the plugging of the desired number of perforations at the proper time during the treatment is left largely to chance. It is also difficult to control which perforated interval of the perforated casing will receive the balls and in many instances results in undesired stimulation in some portions of the formation.

Ball sealers having a density less than the treating fluid have been proposed to improve this seating efficiency problem. In this method, treating fluid containing lightweight ball sealers is injected down the well at a rate such that the downward velocity of the fluid is sufficient to impart a downward drag force on the ball sealers greater in magnitude than the upper buoyancy force of the ball sealers. Once the ball sealers have reached the perforations, they all will seat and plug the perforations and cause the treating fluid to be diverted to the remaining open perforations. One problem with using lightweight ball sealers is that if the downward flow of fluid in the casing is slow, which is generally the case with matrix acidizing treatments, the treating fluid may not overcome the upward buoyancy force of the ball sealers and thus the ball sealers may not be transported to the perforations. Another problem is that it is sometimes difficult to control which interval of the formation will be treated. Lightweight balls carried down the casing by the more dense treating fluid often plug the upper perforations before plugging the lower perforations.

SUMMARY

The present invention provides an improved method for temporarily restricting flow of a treating fluid through lower perforations in a cased wellbore while injecting treating fluid through upper perforations in the cased wellbore. Broadly, the invention comprises introducing into a well casing which is perforated at a plurality of levels: ball sealers designed to plug at least one of the perforations in the casing; a first fluid having a density greater than the ball sealers density, and a second fluid having a density less than the ball sealers density. The ball sealers, the first fluid or the second fluid may be introduced into the well concurrently or in any order. The first fluid is introduced into the well in an amount sufficient to fill the lower portion of the well to a level between the perforations to be left open and the perforations to be temporarily restricted to fluid flow. The density differential between the ball sealers and the fluids in the well will cause the balls to travel to the interface or transition zone between the first fluid and the second fluid. Once the ball sealers are below the level to be treated, a treating fluid is injected into the well. Fluid flow through perforations below the ball sealers will carry the ball sealers to the perforations where the ball sealers will seat and divert further injection of treating fluid through the upper perforations. This process may be repeated to treat any number of zones in the formation.

In a preferred embodiment, the first fluid is an aqueous brine solution having a density greater than about 1.1 g/cc the second fluid is diesel oil having a density less than 0.95 g/cc and the ball sealers are made of a syntactic foam core and a polyurethane cover and have a density between about 1.0 g/cc and 1.05 g/cc.

This invention permits lightweight ball sealers to be used for restricting flow of treating fluid through perforations in a lower portion of a well with 100% efficiency while not interferring with injection of treating fluid through perforations in an upper portion of a well. This method therefore offers significant advantages over methods used in the prior art for fluid diversion.

BRIEF DESCRIPTION OF THE DRAWING

The FIGURE is an elevation view in section of a well illustrating the practice of the present invention.

DESCRIPTION OF THE PREFERRED EMBODIMENTS

The present invention is applicable in wellbores having a casing arranged therein which penetrates a plurality of hydrocarbon productive intervals, formations, zones or strata. Frequently the oil productive intervals overlie one another and may be separated by non-productive intervals. When treating fluids are injected into a well in communication with the plurality of intervals, the interval less resistant to treatment has its permeability or productivity increased while those intervals less susceptible to treatment are not increased in permeability or productivity. One zone is treated in favor of the other. This invention is particularly applicable for increasing the permeability or productivity of an upper productive interval by stimulating methods, such as by hydraulic fracturing or acidizing, while restricting fluid flow into a lower productive interval.

The practice of one embodiment of this invention will be described with reference to the FIGURE. The FIGURE shows a well 10 having a casing 12 run to the bottom of the wellbore. The well passes through an upper hydrocarbon productive interval 14 and a lower hydrocarbon productive interval 15. It is assumed for this embodiment that the lower interval 15 has a higher permeability than upper interval 14. The casing is shown being bonded to the sides of the borehole by cement around the outside to hold the casing in place and to isolate intervals 14 and 15 penetrated by the well. The cement sheath 13 extends upward from the bottom of the wellbore to the earth's surface. The interval 14 is in fluid communication with the interior of the casing 12 through perforations 17 and interval 15 is in fluid communication with the interior of the casing through perforations 16.

Hydrocarbons of producing intervals 14 and 15 flow through the perforations 16 and 17 into the interior of the casing 13 and are transported to the surface through production tubing 19. A production packer is installed near the lower end of the production tubing 19 and above upper interval 14 to achieve a pressure seal between the production tubing 19 and the casing 12. Production tubing is not always used and in those cases the entire interior volume of the casing is used to conduct the hydrocarbons to the surface of the earth. Because lower interval 15 has a higher permeability than upper interval 14 to suitably stimulate the upper interval 14 by fracturing or acidizing, it is necessary to restrict flow of treating fluids into lower interval 15.

The first step in isolating lower interval 15 from upper interval 14 in accordance with this invention, is to introduce into the wellbore a fluid having density greater than the density of the ball sealers. The dense fluid, identified by the numeral 20 in the FIGURE, is pumped into the well in an amount sufficient to fill the lower portion of the wellbore to a level between the perforations 16 of lower interval 15 and perforations 17 of the upper interval 14.

The dense liquid 20 used for filling the lower portion of the well should have a density greater than the density of the ball sealers introduced in the well. This is desirable in order that ball sealers will float on the dense fluid 20 above perforations 16. The density of fluid 20 will depend of course on the density of the ball sealers used in the well, but the fluid will normally have a minimum density above 1 gram per cubic centimeter (g/cc) and preferably a density above about 1.10 g/cc. Any liquid that has the requisite density characteristics and is inert with the ball sealers may be used in this invention. Suitable dense fluids may include aqueous fluids including brine solutions and calcium bromide solutions and non-aqueous fluids including orthonitrotoluene, carbon disulfide, dimethylphthalate, nitrobenzene and isoquinoline.

Once the dense fluid is introduced into the casing, a fluid having a density less than the density of the ball sealers is introduced into the casing. This light fluid, identified by numeral 21 in the FIGURE, will be disposed in the well above the dense fluid and preferably fills the well to a level adjacent perforations 17 of interval 14. Any liquid which has a density less than ball sealers density may be used in this practice of this invention. Suitable light fluids include hydrocarbons such as diesel fuel and light hydrocarbon condensates. The light fluid 21 may also be the same fluid used to treat interval 14 provided the treating fluid density is less than the ball sealers density.

After the dense fluid 20 and light fluid 21 are introduced into the well, ball sealers 22 having a density between the density of dense fluid 21 and light fluid 20 are introduced into the well. These ball sealers are designed to have an outer covering sufficiently compliant to seal a jet formed perforation and to have a solid rigid core which resists extrusion into or through the perforations. The balls are preferably approximately spherical in shape but other geometries may be used. Because of the density differential between the ball sealers and the light fluid 21, the ball sealers will sink to the bottom of light fluid 21 and float to the top of the dense fluid 20.

Once the ball sealers 22 are disposed in the well between intervals 14 and 15, and preferably after all the balls are floating at the top of the dense fluid 20, as shown in the FIGURE, a treating fluid is injected into the well to treat formation 14. The treating fluid may include an acid, water solution, or hydrocarbon solution such that the formation permeability or productivity is increased by physical cracking or fracturing or by reaction of a chemical agent, such as acid, with the formation material. As the treating fluid is injected, any fluid flow into interval 15 will cause the level of dense fluid 20 to decrease. Once the balls 22 arrive at the perforations 16, the flow of fluid 21 through the perforations 16 carries the ball sealers over to and seats them on the perforations. The ball sealers are held there by the fluid pressure differential and thereby effectively close perforations 16. Since the perforations 16 of interval 15 are sealed, pressure builds up in the casing and treating fluid passes through perforations 17 into the interval 14.

The density of the treating fluid may be equal to, or greater than, or less than the density of the ball sealers. If the treating fluid has a density greater than the ball sealers, the light fluid 21 cannot be the same as the treating fluid because the light fluid must have a density less than the ball sealer density to insure that the balls are kept below the perforations through which treating fluid is to flow.

After interval 14 has been suitably treated, pressure of the wellhead is released and the differential pressure from the formation toward the wellbore causes the ball sealers to be released from the perforations 16. Additional intervals (not shown) may then be selectively treated according to this invention by introducing additional dense fluid 20 into the well to float the ball sealers to a position above the perforations of the next higher interval to be temporarily plugged and below the perforation of the next higher interval to be treated, introducing additional light fluid to replenish the light fluid lost during prior treating step and then injecting additional treating fluid to treat the next higher interval or intervals above the ball sealers.

Although the ball sealers, dense fluid 20, and light fluid 21 in the above embodiment were introduced into the casing sequentially, it should be understood that the ball sealers 22 and fluids 20 and 21 may be introduced in the casing in any order, and may be introduced concurrently. In another embodiment, dense fluid 20 and light fluid 21 may be pumped into the well simultaneously with ball sealers subsequently introduced into the casing at the wellhead by a dispenser or other suitable injection device.

The ball sealers positioned in the well according to this invention do not interfere with the injection of treating fluids during multi-stage treatment of a formation. The ball sealers disposed in the well between intervals 14 and 15 will seat upon the perforations 16 which have fluid flowing therethrough with 100% efficiency. That is, each and every ball sealer will seat and plug a perforation 16 as long as there is a perforation 16 through which fluid is flowing. If the low density fluid 21 flows through the lower perforations 16, the ball sealers will seat. A predictable diversion process will occur because the number of perforations plugged by the ball sealers will be equal to the number of ball sealers injected into the casing. Therefore, the number of ball sealers to use in carrying out the present invention depends upon the number of perforations to be restricted. Because of the high seating efficiency, an excess of such ball sealers normally will be unnecessary.

To apply the present invention in the field, it is necessary to have ball sealers that have a density less than the density of the dense fluid 20 and a density greater than the density of light fluid 21, and at the same time have the strength to withstand the pressures encountered in the wellbore. It is not unusual for the bottom hole pressure to exceed 10,000 psi and even 15,000 psi during well treatment. If a ball sealer cannot withstand these pressures, they will collapse causing the density of the ball sealer to increase to a density which can easily exceed the dense fluid 21.

The dense fluid 20 will generally have a density of at least 1.0 g/cc and the light fluid 21 will generally have a density less than about 0.8 g/cc. The density of the ball sealers will therefore generally range from about 0.8 to 1.1 g/cc.

It may be seen that the present invention possesses a number of advantages over procedures now used in multi-zone treatment or stimulation techniques. With the process of the present invention, any zone can be treated with any desired treatment volume with essentially no loss in efficiency from fluid being lost to perforations below the zone to be treated. The advantages of the present invention over methods previously used to exclude intervals from receiving injection fluids include simplicity because no expensive equipment is required to perform the process and flexibility because changes in injection elevation may be made quickly and cheaply.

The principle of this invention and the best mode in which it is contemplated to apply that principle has been described. It is to be understood that the foregoing is illustrative only and that other means and techniques can be employed without departing from the true scope of the invention defined in the claims.

We claim:

1. A method for treating a formation penetrated by a well provided with casing having a plurality of perforations wherein ball sealers are used for restricting flow through lower perforations while leaving upper perforations open to fluid flow comprising:

(a) introducing into the well ball sealers having a size sufficient to restrict fluid flow through said lower perforations;

(b) introducing into the well a first fluid having a density greater than the density of the ball sealers in an amount such that the upper level of the fluid is between said upper perforations and said lower perforations;

(c) introducing into the well a second fluid having a density less than the ball sealers density; and (d) after said ball sealers are below said upper perforations, injecting a treating fluid into the casing to cause a flow of said second fluid through said lower perforations to carry said ball sealers down the casing to seat on said lower perforations and to cause a flow of fluid through the upper perforations.

2. The method is to define claim 1 wherein said first fluid comprises an aqueous liquid.

3. The method as defined in claim 1 wherein the second fluid comprises a hydrocarbon liquid.

4. The method as defined in claim 1 wherein the treating fluid is a fracturing fluid.

5. The method as defined in claim 1 wherein the treating fluid is an acid solution.

6. The method as defined in claim 1 wherein the steps, a, b, and c are performed simultaneously.

7. The method as defined in claim 1 wherein step a is performed after steps b and c.

8. The method as defined in claim 1 wherein step b is performed before steps a and c.

9. The method as defined in claim 1 wherein said second fluid is the same fluid as said treating fluid.

10. The method as defined in claim 1 wherein said second fluid has a density less than the density of said treating fluid.

11. The method as defined in claim 1 further comprising allowing essentially all the ball sealers introduced into the well to float essentially to the top of the first fluid and to gravitate essentially to the bottom of the second fluid prior to the injection of the treating fluid into the casing.

12. The method as defined in claim 1 wherein the density of the ball sealers is greater than treating fluid density.

13. The method as defined in claim 1 wherein the density of the ball sealers is less than the treating fluid density.

14. The method as defined in claim 1 further comprising stopping injecting of the treating fluid into said casing, introducing into the well additional fluid having a density greater than the density of the ball sealers in an amount sufficient to float the ball sealers to a level between the next upper perforations and said upper perforations, introducing additional fluid having a density less than the ball sealer density and thereafter injecting treating fluid through said next upper perforations.

15. A method of treating with a fluid an earth formation penetrated by a well provided with a casing, said casing having perforations at a plurality of intervals, said method comprising the steps of introducing a first fluid into the casing to a level between an upper perforation and lower perforation;

introducing into the casing a ball sealer having a size sufficient to plug the lower perforations and having a density less than the first fluid density;

allowing said ball sealer to gravitate between said upper perforation and said lower perforation;

introducing into the well a second fluid having a density less than the ball sealer density; and thereafter, injecting a treating fluid into the well to treat the formation through said upper perforations.

16. A method for selectively treating a plurality of hydrocarbon productive intervals penetrated by a wellbore having casing perforated adjacent the intervals which comprises introducing a first fluid into the wellbore to a level between the upper perforation of a lower interval and the lower perforation of an upper interval;

introducing into the well a second fluid having a density less than the density of the first fluid;

introducing into the well ball sealers adapted to seal the perforations of the lower interval and having a density betweeen the density of the first fluid and the density of the second fluid;

thereafter, injecting a treating fluid into the formation to treat the upper interval.

* * * * *